US011352679B2

(12) United States Patent
Palzer et al.

(10) Patent No.: US 11,352,679 B2
(45) Date of Patent: Jun. 7, 2022

(54) MEDIUM-MANGANESE STEEL PRODUCT FOR LOW-TEMPERATURE USE AND METHOD FOR THE PRODUCTION THEREOF

(71) Applicant: SALZGITTER FLACHSTAHL GMBH, Salzgitter (DE)

(72) Inventors: Peter Palzer, Liebenburg (DE); Manuel Otto, Cremlingen (DE); Kai Köhler, Nordstemmen (DE); Thomas Evertz, Peine (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 172 days.

(21) Appl. No.: 16/346,761

(22) PCT Filed: Oct. 27, 2017

(86) PCT No.: PCT/EP2017/077628

§ 371 (c)(1),
(2) Date: May 1, 2019

(87) PCT Pub. No.: WO2018/083035

PCT Pub. Date: May 11, 2018

(65) Prior Publication Data

US 2019/0264297 A1 Aug. 29, 2019

(30) Foreign Application Priority Data

Nov. 2, 2016 (DE) ..... 102016120895.7

(51) Int. Cl.

| | |
|---|---|
| ***C21D 8/10*** | (2006.01) |
| ***C21D 9/08*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |

(Continued)

(52) U.S. Cl.

CPC ..... *C21D 8/105* (2013.01); *C21D 1/26* (2013.01); *C21D 6/005* (2013.01); *C21D 9/08* (2013.01); *C21D 9/46* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/105* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/30* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *B21C 37/08* (2013.01); *B21C 37/122* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 8/0278* (2013.01); *C21D 8/10* (2013.01); *C21D 2201/02* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 2211/002; C21D 2211/005; C21D 2211/008; C21D 8/105; C21D 9/08; C21D 9/46; C21D 8/0205; C21D 8/0226; C21D 8/0236; C21D 8/0278; C22C 38/02; C22C 38/06; C22C 38/44; C22C 38/58

See application file for complete search history.

(56) References Cited

U.S. PATENT DOCUMENTS

| | | | |
|---|---|---|---|
| 4,257,808 | A | 3/1981 | Morris, Jr. et al. |
| 5,256,219 | A | 10/1993 | Hagen et al. |

(Continued)

FOREIGN PATENT DOCUMENTS

| | | | |
|---|---|---|---|
| CN | 103422017 | A | 12/2013 |
| CN | 103221562 | B | 7/2016 |

(Continued)

OTHER PUBLICATIONS

JP-2005060795-A English translation from EPO, Araya Masatoshi; Kimura Mitsuo; Miyata Yukio; Yamazaki Yoshio, 2005 (Year: 2005).*

(Continued)

*Primary Examiner* — Anthony J Zimmer
*Assistant Examiner* — Jacob J Gusewelle
(74) *Attorney, Agent, or Firm* — Henry M. Feiereisen LLC

(57) ABSTRACT

A steel product includes the following chemical composition in wt. %: C: 0.01 to <0.3, Mn: 4 to <10, Al: 0.003 to 2.9, Mo: 0.01 to 0.8, Si: 0.02 to 0.8, Ni: 0.005 to 3, P: <0.04, S: <0.02, N: <0.02, with the remainder being iron including unavoidable steel-associated elements, wherein an alloy composition satisfies the equation 6<1.5 Mn+Ni<8; or the equation 0.11<C+Al<3, or an alloy composition contains, in addition to Ni, at least one or more of the elements, in wt. %, B: 0.0005 to 0.014; V: 0.006 to 0.1; Nb: 0.003 to 0.1; Co: 0.003 to 3; W: 0.03 to 2 or Zr: 0.03 to 1. The steel product has a microstructure of 2 to 90 vol. % austenite, less than 40 vol. % ferrite and/or bainite, with the remainder being martensite.

16 Claims, No Drawings

(51) Int. Cl.

| | |
|---|---|
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/18*** | (2006.01) |
| ***C22C 38/10*** | (2006.01) |
| ***C21D 6/00*** | (2006.01) |
| ***C22C 38/04*** | (2006.01) |
| ***C22C 38/08*** | (2006.01) |
| ***C22C 38/22*** | (2006.01) |
| ***C22C 38/14*** | (2006.01) |
| ***C21D 1/26*** | (2006.01) |
| ***C22C 38/30*** | (2006.01) |
| ***C22C 38/16*** | (2006.01) |
| ***C22C 38/20*** | (2006.01) |
| ***C22C 38/12*** | (2006.01) |
| *C21D 8/02* | (2006.01) |
| *B21C 37/08* | (2006.01) |
| *B21C 37/12* | (2006.01) |

(56) References Cited

U.S. PATENT DOCUMENTS

| | | | | |
|---|---|---|---|---|
| 5,310,431 | A | 5/1994 | Buck | |
| 2012/0070330 | A1 | 3/2012 | Ishii et al. | |
| 2013/0087253 | A1* | 4/2013 | Matsuda | C22C 38/20 148/533 |
| 2013/0174941 | A1 | 7/2013 | Um et al. | |
| 2014/0014236 | A1 | 1/2014 | Nozaki et al. | |
| 2014/0230971 | A1 | 8/2014 | Kawasaki et al. | |
| 2015/0329951 | A1* | 11/2015 | Jeon | C22C 38/34 428/639 |

FOREIGN PATENT DOCUMENTS

| | | | | |
|---|---|---|---|---|
| DE | 102012013113 | A1 | 12/2013 | |
| EP | 2055797 | A1 | 5/2009 | |
| EP | 2383353 | A2 | 11/2011 | |
| EP | 2641987 | A2 * | 9/2013 | C22C 38/06 |
| EP | 2641987 | A2 | 9/2013 | |
| JP | 2001192773 | | 7/2001 | |
| JP | 2005060795 | A * | 3/2005 | |
| KR | 1020120083847 | | 7/2012 | |
| RU | 2269588 | C1 | 2/2006 | |
| RU | 2414520 | C1 | 3/2011 | |
| WO | WO 2005/061152 | A1 | 7/2005 | |
| WO | WO 2006/011503 | A1 | 2/2006 | |

OTHER PUBLICATIONS

Russian Search Report dated Jan. 30, 2020 with respect to counterpart Chinese patent application 2019116309/02(031119).

Translation of Russian Search Report dated Jan. 30, 2020 with respect to counterpart Chinese patent application 2019116309/02(031119).

International Search Report issued by the European Patent Office in International Application PCT/EP2017/077628.

* cited by examiner

MEDIUM-MANGANESE STEEL PRODUCT FOR LOW-TEMPERATURE USE AND METHOD FOR THE PRODUCTION THEREOF

CROSS-REFERENCES TO RELATED APPLICATIONS

This application is the U.S. National Stage of International Application No. PCT/EP2017/077628, filed Oct. 27, 2017, which designated the United States and has been published as International Publication No. WO 2018/083035 and which claims the priority of German Patent Application, Serial No. 10 2016 120 896.7, filed Nov. 2, 2016, pursuant to 35 U.S.C. 119(a)-(d).

BACKGROUND OF THE INVENTION

The invention relates to a medium manganese steel product for use at low temperatures, and to a method for producing same in the form of a flat steel product or a seamless pipe.

In particular, the invention relates to the production of a steel product from a medium manganese steel having excellent low-temperature ductility and/or high strength, for use in temperature ranges down to at least minus 196° C., which optionally has a TRIP (TRansformation Induced Plasticity) and/or TWIP (TWinning Induced Plasticity) effect. The term "steel products" is understood hereinafter to mean in particular flat steel products such as steel strips (hot or cold rolled) or thick plates and welded, or even seamless, pipes produced therefrom.

European laid-open document EP 2 641 987 A2 discloses a medium manganese, high-strength steel and a method for producing this steel. The steel has a notch impact strength of 70 J at −196° C. and consists of the following elements (contents in wt. % and relating to the steel melt): C: to 0.01 to 0.06; Mn: 2.0 to 8.0; Ni: 0.01 to 6.0; Mo: 0.02 to 0.6; Si: 0.03 up to 0.5; Al: 0.003 to 0.05; N: 0.0015 to 0.01; P: up to 0.02; S: up to 0.01; with the remainder being iron and unavoidable impurities. This steel is said to be characterized in that it can be produced in a more cost-effective manner than steels containing up to 9 wt. % nickel which were previously used for this usage purpose. A method for producing a flat steel product from the high-strength, medium manganese steel described above comprises the following working steps: —heating a steel slab to a temperature of 1000° C. to 1250° C., —rolling the slab at a final rolling temperature of 950° C. or less at a reduction rate (degree of rolling) of 40% or less, —cooling the rolled steel to a temperature of 400° C. or less at a cooling rate of 2° K./s or more, —and, following the cooling, tempering the steel for 0.5 to 4 hours at a temperature between 550° C. and 650° C. The microstructure of the steel comprises, as the main phase, martensite and 3 to 15 vol. % residual austenite.

U.S. Pat. No. 5,256,219 discloses a medium manganese steel for a door reinforcement tube which contains, in addition to iron, the following elements: C: 0.15 to 0.25%; Mn: 3.4 to 6.1%; P: max. 0.03%; 5: max. 0.03%; Si: max, 0.6%; Al: 0.05%; Ni, Cr, Mo: 0 to 1%; V: 0 to 0.15%. A microstructure composition of the steel is not described.

U.S. Pat. No. 5,310,431 discloses a corrosion-resistant, martensitic steel which contains, in addition to iron and impurities, the following elements: C: 0.05 to 0.15%; Cr: 2 to 15%; Co: 0.1 to 10%; Ni: 0.1 to 4%; Mo: 0.1 to 2%; Ti: 0.1 to 0.75%; B: <0.1%; N: <0.02%. In addition, the described steel can also contain e.g. <5% Mn.

Laid-open document US 2014/0230971 A1 discloses a high-strength steel sheet having excellent deformation properties and a method for producing same. In addition to iron and unavoidable impurities, the steel sheet consists of the following elements (in wt. %): C: 0.03 to 0.35; Si: 0.5 to 3; Mn: 3.5 to 10; P: <0.1; 5: <0.01; N: <0.08. A microstructure is provided with more than 30% ferrite and more than 10% residual austenite.

Laid-open document WO 2006/011503 A1 also describes a steel sheet, the chemical composition of which is given as follows, in wt. %: C: 0.0005 to 0.3; Si: <2.5, Mn: 2.7 to 5; P: <0.15; S: <0.015; Mo: 0.15 to 1.5; B: 0.0006 to 0.01; Al: <0.15 with the remainder being iron and unavoidable impurities. Such a steel strip is characterized by a high modulus of elasticity of greater than 230 Gpa in the rolling direction.

European laid-open document EP 2 055 797 A1 relates to a ferromagnetic, iron-based alloy, the composition of which contains one or more of the following elements in wt %; Al: 0.01 to 11; Si: 0.01 to 7; Cr: 0.01 to 26 with the remainder being iron and unavoidable impurities. The alloy can optionally also contain 0.01 to 5 wt. % Mn and other elements.

Furthermore, German laid-open document DE 10 2012 013 113 A1 already describes so-called TRIP steels which have a predominantly ferritic basic microstructure having incorporated residual austenite which can convert into martensite during deformation (TRIP effect). Owing to its intense cold-hardening, the TRIP steel achieves high values for uniform elongation and tensile strength. TRIP steels are used inter alia in structural components, chassis components and crash-relevant components of vehicles, as sheet metal blanks and as welded blanks.

Furthermore, laid-open document WO 2005/061152 A1 discloses hot strips consisting of TRIP/TWIP steels having manganese contents of 9 to 30 wt. %, wherein the melt is cast using a horizontal strip casting installation to form a pre-strip between 6 and 15 mm and is then rolled out to form a hot strip.

Proceeding therefrom, the object of the present invention is to provide a steel product consisting of manganese steel which can be produced in a cost-effective manner and has an advantageous combination of strength and elongation properties at low temperatures and optionally has a TRIP and/or TWIP effect. Furthermore, a method for producing such a steel product is to be provided.

SUMMARY OF THE INVENTION

In accordance with the invention, the object is achieved by a medium manganese steel product for low temperature use with a minimum notch impact energy at −196° C. in the transverse direction of ≥50 J/cm$^2$ with the following chemical composition in wt. %: C: 0.01 to <0.3; Mn: 4 to <10; Al: 0.003 to 2.9; Mo: 0.01 to 0.8; Si: 0.02 to 0.8; Ni: 0.005 to 3, preferably 0.01 to 3; P: <0.04; 5: <0.02; N: <0.02; with the remainder being iron including unavoidable steel-associated elements, wherein for the alloy composition the equation $6<1.5\ Mn+Ni<8$ is satisfied with optional addition by alloying of one or more of the following elements: Ti, V, Cr, Cu, Nb, B, Co, W, Zr, Ca and Sn, or for the alloy composition the equation $0.11<C+Al<3$ is satisfied with optional addition by alloying of one or more of the following elements: Ti, V, Cr, Cu, Nb, B, Co, W, Zr, Ca and Sn, or the alloy composition, in addition to Ni, contains at least one or more of the elements B, V, Nb, Co, W or Zr with optional addition by alloying of one or more of the following elements: Ti, Cr, Cu, Ca and Sn, comprising a microstructure comprised of 2 to 90 vol. % austenite, less than 40 vol. % ferrite and/or bainite, with the remainder being martensite or tempered martensite, offers an excellent low-temperature ductility at temperatures less than room temperature to at least −196° C. and a good combination of strength, elongation and forming properties.

Advantageous embodiments of the invention are described in the dependent claims.

The aforementioned features in relation to the two equations and the additional alloy elements in addition to Ni are to be understood as equal alternatives and thus are separated from each other by "or".

Moreover, the production of this medium manganese steel in accordance with the invention on the basis of the alloy elements C, Mn, Al, Mo and Si is cost-effective because it is generally possible to avoid the increased addition of nickel of up to 9 wt. % to achieve the low-temperature ductility. The steel product in accordance with the invention also has, at low temperatures down to at least −196° C., a stable austenite content which converts at the earliest upon deformation at low temperatures but otherwise is present in a metastable or stable form. This austenite content of at least 2 vol. % present at the low temperatures improves the low-temperature ductility and thus the elongation properties.

In an advantageous manner, the steel product in accordance with the invention can be used as a substitute for high nickel steels in low-temperature applications, such as e.g. in the fields of shipbuilding, boiler construction/vessel construction, construction machinery, transport vehicles, crane construction, the mining industry, machine and plant design, power generation industry, oilfield pipes, petrochemistry, wind turbines, high-pressure pipelines, precision pipes, pipes in general and for the substitution of high-alloy steels, in particular Cr, CrN, CrMnN, CrNi, CrMnNi steels.

The elements optionally added by alloying advantageously have the following contents in wt. %: Ti: 0.002 to 0.5; V: 0.006 to 0.1; Cr: 0.05 to 4; Cu: 0.05 to 2; Nb: 0.003 to 0.1; B: 0.0005 to 0.014; Co: 0.003 to 3; W: 0.03 to 2; Zr: 0.03 to 1; Ca: <0.004 and Sn: <0.5

The steel product in accordance with the invention, in particular in the form of a seamless pipe, has a multi-phase microstructure, consisting of 2 to 90 vol. %, preferably to 80 vol. %, or to 70 vol. % austenite, less than 40 vol. %, preferably less than 20 vol. % ferrite and/or bainite, with the remainder being martensite or tempered martensite, and optionally has a TRIP and/or TWIP effect. A portion of the martensite is present as tempered martensite and a portion of the austenite of up to 90% can be present in the form of annealing or deformation twins. The steel can optionally have a TRP and also a TWIP effect, wherein a portion of the austenite can convert into martensite during subsequent deformation/moulding/processing of the steel strip, wherein at least 20% of the original austenite still has to be retained in order to ensure the low-temperature properties.

The steel product in accordance with the invention is also characterized by an increased resistance to delayed crack formation (delayed fracture) and to hydrogen embrittlement. This is achieved in the present case by a precipitation of molybdenum carbide which acts as a hydrogen trap. In addition, the steel has a high resistance to liquid metal embrittlement (LME) during welding.

The use of the term "to" in the definition of the content ranges, such as e.g. 0.01 to 1 wt. %, means that the limit values—0.01 and 1 in the example—are also included.

The steel in accordance with the invention is particularly suitable for producing thick plates or hot and cold strips as well as welded and seamless pipes which can be provided with metallic or non-metallic, organic or various inorganic coats.

The steel product advantageously has, at room temperature, an elasticity limit Rp0.2 of 450 to 1150 MPa, a tensile strength Rm of 500 to 2100 MPa and an elongation at fracture A50 of more than 6% to 45%, wherein higher tensile strengths tend to be associated with lower elongations at fracture and vice versa. A flat sample having an initial measured length A50 was used for the elongation at fracture tests with tensile test as per DIN 50 125.

Alloy elements are generally added to the steel hi order to influence specific properties in a targeted manner. An alloy element can thereby influence different properties in different steels. The effect and interaction generally depend considerably upon the quantity, presence of further alloy elements and the solution state in the material. The correlations are varied and complex. The effect of the alloy elements in the alloy in accordance with the invention will be discussed in greater detail hereinafter. The positive effects of the alloy elements used in accordance with the invention will be described hereinafter:

Carbon C: Cis required to form carbides, stabilizes the austenite and increases the strength. Higher contents of C impair the welding properties and result in the impairment of the elongation and toughness properties, for which reason a maximum content of less than 0.3 wt. % is set. In order to achieve a fine precipitation of carbides, a minimum addition of 0.01 wt. % is required. For an optimum combination of mechanical properties and welding capability, the C content is advantageously set to 0.03 to 0.15 wt. %.

Manganese Mn: Mn stabilizes the austenite, increases the strength and the toughness and optionally renders possible a deformation-induced martensite formation and/or twinning in the alloy in accordance with the invention. Contents of less than 4 wt. % are not sufficient to stabilize the austenite and thus impair the elongation properties, whereas with contents of 10 wt. % and more the austenite is stabilized too much, thus the deformation-induced mechanisms of the TRIP and TWIP effect do not become sufficiently effective, and as a result the strength properties, in particular the 0.2% elasticity omit, are reduced. For the manganese steel in accordance with the invention having medium manganese contents, a range of 4 to <8 wt. % is preferred.

Aluminium Al: Al is used to deoxidize the melt. An Al content of 0.003 wt. % and more is used to deoxidize the melt. This produces increased outlay when casting. Al contents of more than 0.03 wt. % deoxidize the melt completely, influence the conversion behavior and improve the strength and elongation properties. Contents of Al of more than 2.9 wt. % impair the elongation properties. Higher Al contents also considerably impair the casting behavior in the continuous casting process. Therefore, a maximum content of 2.9 wt. % and a minimum content of more than 0.003 wt. % are set. However, the steel preferably has an Al content of 0.03 to 0.4 wt. %.

Furthermore, for contents of Ni>0.01 wt. %, for the sum of C and Al a minimum content (in wt. %) of more than 0.11 and less than 3 should be maintained, whereby the strength of the austenite is increased in particular by C but the precipitation of undesired coarse carbides by Al is suppressed. A content of C+Al of 3 wt. % and more impairs the strength properties and renders production more difficult. With total contents of C+Al of 0.11 wt. % or less, tensile strengths of >1200 MPa cannot be achieved with the stated alloy after the final heat treatment.

Silicon Si: the addition of Si in contents of more than 0.02 wt. % impedes the diffusion of carbon, reduces the relative density and increases the strength and elongation properties and toughness properties. Furthermore, an improvement in the cold-rollability could be seen by adding Si by alloying. Contents of more than 0.8 wt. % result in embrittlement of the material and negatively influence the hot- and cold-rollability and the coatability e.g. by galvanizing. Therefore, a maximum content of 0.8 wt. % and a minimum content of 0.02 wt. % are set. Contents of 0.08 to 0.3 wt. % have proven to be optimum.

Molybdenum Mo: Mo acts as a carbide-forming agent, increases the strength and increases the resistance to hydrogen-induced delayed crack formation and hydrogen embrittlement. Contents of Mo of more than 0.8 wt. % impair the elongation properties, for which reason a maximum content of 0.8 wt. % and a minimum content of 0.01 wt. % required for sufficient efficacy are set. A content of Mo of 0.1 to 0.5 wt. % has proved to be advantageous in relation to an increase in strength in conjunction with keeping costs as low as possible.

Phosphorus P: Pis a trace element or associated element from iron ore and is dissolved in the iron lattice as a substitution atom. Phosphorus increases the hardness by means of solid solution hardening and improves the hardenability. However, attempts are generally made to lower the phosphorus content as much as possible because inter alfa it exhibits a strong tendency towards segregation owing to its low diffusion rate and greatly reduces the level of toughness. The attachment of phosphorus to the grain boundaries can cause cracks along the grain boundaries during hot rolling. Moreover, phosphorus increases the transition temperature from tough to brittle behavior by up to 300° C. For the aforementioned reasons, the phosphorus content is limited to values of less than 0.04 wt. %.

Sulphur S: S, like phosphorus, is bound as a trace element or associated element in the iron ore or is incorporated by coke during production via the blast furnace route. It is generally not desirable in steel because it exhibits a tendency towards extensive segregation and has a greatly embrittling effect, whereby the elongation and toughness properties are impaired, An attempt is therefore made to achieve amounts of sulphur in the melt which are as low as possible (e.g. by deep desulphurization). For the aforementioned reasons, the sulphur content is limited to values of less than 0.02 wt. %.

Nitrogen N: N is likewise an associated element from steel production. In the dissolved state, it improves the strength and toughness properties in high manganese steels with greater than or equal to 4 wt. % Mn. Lower Mn-alloyed steels with less than 4 wt. % tend, in the presence of free nitrogen, to have a strong ageing effect. The nitrogen diffuses even at low temperatures to dislocations and blocks same. It thus produces an increase in strength associated with a rapid loss of toughness. Binding of the nitrogen in the form of nitrides is possible e.g. by adding aluminium and/or titanium and Nb, V, B by alloying, wherein in particular aluminium nitrides have a negative effect upon the forming properties of the alloy in accordance with the invention. For the aforementioned reasons, the nitrogen content is limited to less than 0.02 wt. %.

Titanium Ti: when optionally added, Ti acts in a grain-refining manner as a carbide-forming agent, whereby at the same time the strength, toughness and elongation properties are improved. Furthermore, Ti reduces the inter-crystalline corrosion. Ti contents of more than 0.5 wt. % impair the elongation properties, for which reason a maximum Ti content of 0.5 wt. % is set. Optionally, a minimum content of 0.002 is set in order to advantageously precipitate nitrogen with Ti.

Vanadium V: when optionally added, V acts in a grain-refining manner as a carbide-forming agent, whereby at the same time the strength, toughness and elongation properties are improved. V contents of more than 0.1 wt. % do not produce any further advantages, for which reason a maximum content of 0.1 wt. % is set. Optionally, a minimum content of 0.006 wt. % is set which is required for precipitation of the finest carbides.

Chromium Cr: when optionally added, Cr improves the strength and reduces the rate of corrosion, delays the formation of ferrite and perlite and forms carbides. The maximum content is set to 4 wt. % since higher contents result in an impairment of the elongation properties. A minimum effective Cr content is set to 0.05 wt. %.

Nickel Ni: The optional addition of at least 0.005 wt. %, preferably 0.01 wt. %, nickel ensures stabilization of the ausienite, in particular at lower temperatures, and improves the strength and toughness properties and reduces the formation of carbides. The maximum content is set to 3 wt. % for cost reasons. A maximum content of Ni of 1 wt. % has proved to be particularly economical.

A particularly cost-effective alloy system can be achieved when, in combination with manganese, the following condition is satisfied: $6<1.5\ Mn+Ni<8$.

Copper Cu: Cu reduces the rate of corrosion and increases the strength. Contents of greater than 2 wt. % impair producibility by forming low melting point phases during casting and hot-rolling, for which reason a maximum content of 2 wt. % is set. In order for Cu to have a strength-increasing effect, a minimum of 0.05 wt. % is set.

Niobium Nb: when optionally added, Nb acts in a grain-refining manner as a carbide-forming agent, whereby at the same time the strength, toughness and elongation properties are improved. Nb contents of more than 0.1 wt. % do not produce any further advantages, for which reason a maximum content of 0.1 wt. % is set. Optionally, a minimum content of 0.003 wt. % is set which is required for precipitation of the finest carbides.

Boron B: B delays the austenite conversion, improves the hot-forming properties of steels and increases the strength at room temperature. It achieves its effect even with very low alloy contents. Contents above 0.008 wt. % increasingly impair the elongation and toughness properties, for which reason the maximum content is set to 0.014 wt. %. Optionally, a mininium content of 0.0005 wt. % is set in order to advantageously use the strength-increasing effect of boron.

Cobalt Co: Co increases the strength of the steel and stabilizes the austenite. Contents of more than 3 wt. % impair the elongation properties, for which reason a maximum content of 3 wt. % is optionally set. Preferably, an optional minimum content of 0.003 wt. % is provided which advantageously influences in particular the austenite stability along with the strength properties.

Tungsten W: W acts as a carbide-forming agent and increases the strength. Contents of W of more than 2 wt. % impair the elongation properties, for which reason a maximum content of 2 wt. % W is set. For the effective precipitation of carbides, an optional minimum content of 0.03 wt. % is set.

Zirconium Zr: Zr acts as a carbide-forming agent and improves the strength. Contents of Zr of more than 1 wt. % impair the elongation properties for which reason a maximum content of 1 wt. % is set. In order to permit precipitation of carbides, an optional minimum content of 0.03 wt. % is set.

Calcium Ca: Ca is used for modifying non-metallic oxidic inclusions which could otherwise result in an undesired failure of the alloy as a result of inclusions in the microstructure which act as stress concentration points and weaken the metal composite. Furthermore, Ca improves the homogeneity of the alloy in accordance with the invention. Contents of above 0.004 wt. % Ca do not produce any further advantage in the modification of inclusions, impair producibility and are to be avoided by reason of the high vapor pressure of Ca in steel melts. Therefore, an optional maximum content of 0.004 wt. % is provided.

Tin Sn: Sn increases the strength but, similarly to copper, accumulates beneath the scale layer and at the grain boundaries at higher temperatures. Owing to penetration into the grain boundaries it leads to the formation of low melting point phases and, associated therewith, to cracks in the microstructure and to solder brittleness, for which reason a maximum content of less than 0.5 wt. % is optionally provided.

A steel product in the form of a flat steel product, such as e.g. a hot strip, cold strip or thick plate is provided in accordance with the invention by a method comprising the steps of melting a steel melt containing in wt. %: C: 0.1 to <0.3; Mn: 4 to <10; Al: 0.003 to 2.9; Mo: 0.01 to 0.8; Si: 0.02 to 0.8; <0.04; S: <0.02; N: <0.02; with the remainder being iron including unavoidable steel-associated elements, with optional adding by alloying of one or more of the following elements in wt. %: Ti: 0.002 to 0.07; V: 0.008 to 0.1; Cr: 0.05 to 4; Ni: 0.01 to 3; Cu: 0.05 to 2; Nb: 0.003 to 0.1; B: 0.0005 to 0.014; Co: 0.003 to 3; W: 0.03 to 2; Zr: 0.03 to 1; Ca: less than 0.004; Sn: less than 0.5 via the bast furnace steel plant or electric arc furnace steel plant process route, each with optional vacuum treatment of the melt; casting the steel melt to form a pre-strip by means of a horizontal or vertical strip casting process approximating the final dimensions or casting the steel melt to form a slab or thin slab by means of a horizontal or vertical slab or thin slab casting process, heating to a rolling temperature of 1050° C. to 1250° C. or in-line rolling out of the casting heat, hot rolling the pre-strip or the slab or the thin slab to form a thick plate having a thickness of above 3 to 200 mm or a hot strip having a thickness of 0.8 to 28 mm at a final rolling temperature of 650° C. to 1050° C., reeling the hot strip at a temperature of more than 100° C. to 600° C., optionally acid-cleaning the hot strip, optionally annealing the thick plate or the hot strip in an annealing installation for an annealing time of 0.3 to 24 h and at temperatures of 500° C. to 840° C., preferably 520° C. to 600° C. for an annealing time of 0.5 to 6 h, optionally cold rolling the hot strip at room temperature or elevated temperature of 60° C. to 450° C. prior to the first rolling pass in one or more rolling passes to a thickness of ≤3 mm with a degree of thinning by rolling of 10 to 90%, preferably 30 to 60%, optionally annealing the cold strip in an annealing installation for an annealing time of 0.3 to 24 h and at temperatures of 500° C. to 840° C., preferably 520° C. to 600° C. for an annealing time of 0.5 to 6 h, optionally skin pass rolling the hot or cold strip, optionally electrolytically galvanizing, hot-dip galvanizing or coating with an organic or inorganic coating, wherein the flat steel product has an excellent low-temperature ductility at temperatures of less than −196° C. and a good combination of strength, elongation and forming properties.

If the flat steei product is further processed to form a longitudinal seam welded or spiral seam welded pipe, the annealing process required for achieving the required low-temperature ductility, and thus the setting of the final microstructure, can be effected not on the hot or cold strip but optionally only after the pipe has been produced, wherein the annealing of the pipe is effected in an annealing installation for an annealing time of 0.3 to 24 h and at temperatures of 500° C. to 840° C., preferably 520° C. to 60° C. for an annealing time of 0.5 to 6 h. If required, the pipe can be provided, after annealing, with an organic or inorganic coating on one or both sides.

In relation to other advantages, reference is made to the above statements relating to the steel in accordance with the invention.

Typical thickness ranges for the pre-strip are 1 mm to 35 mm and for slabs and thin slabs they are 35 mm to 450 mm. Provision is preferably made that the slab or thin slab is hot-rolled to form a thick plate with a thickness of above 3 mm to 200 mm or a hot strip having a thickness of 0.8 mm to 28 mm, or the pre-strip, cast to approximately the final dimensions, is hot-rolled to form a hot strip having a thickness of 0.8 mm to 3 mm. The cold strip in accordance with the invention has a thickness of at most 3 mm, preferably 0.1 mm to 1.4 mm.

In the context of the above method in accordance with the invention, a pre-strip produced with the two-roller casting process and approximating the final dimensions and having a thickness of less than or equal to 3 mm, preferably 1 mm to 3 mm, is already understood to be a hot strip. The pre-strip thus produced as a hot strip does not have an original cast structure owing to the introduced deformation of the two rollers rotating in opposite directions. Hot rolling thus already takes place in-line during the two-roller casting process, which means that separate hot rolling can optionally be omitted.

The cold rolling of the hot strip can take place at room temperature or advantageously at elevated temperature prior to the first rolling pass in one or a plurality of rolling passes.

The cold rolling at elevated temperature is advantageous in order to reduce the rolling forces and to aid the formation of deformation twins (TWIP effect). Advantageous temperatures of the material being rolled prior to the first rolling pass are 60° C. to 450° C.

If required, the steel strip can be skin pass rolled after the cold rolling, as a result of which the surface structure (topography) required for the final application is set. The skin pass rolling can be performed e.g. by means of the Pretex®-method.

In one advantageous development, the flat steel product produced in this manner acquires a surface finishing, e.g. by electrolytic galvanizing or hot-dlp galvanizing and, instead of the galvanizing or in addition, a coating on an organic or inorganic basis. The coating systems can be e.g. organic coatings, synthetic material coatings or lacquers or other inorganic coatings, such as e.g. iron oxide layers.

The flat steel product produced in accordance with the invention can be used both as a metal sheet, metal sheet portion or blank or can be further processed to form a longitudinal seam welded or spiral seam welded pipe.

If seamless pipes are to be produced as the steel products, these can be produced in accordance with the invention advantageously with the following method steps:

melting a steel melt containing (in wt. %): C: 0.1 to <0.3; Mn; 4 to <10; Al: 0.003 to 2.9; Mo: 0.01 to 0.8; Si; 0.02 to 0.8; P: <0.04; S; <0.02; N: <0.02; with the remainder being iron including unavoidable steel-associated elements, wherein for the alloy composition the equation 6<1.5 Mn+Ni<8 is satisfied with optional addition by alloying of one or more of the following elements; Ti: 0.002 to 0.07: V: 0.006 to 0.1; Cr: 0.05 to 4; Cu; 0.05 to 2; Nb: 0.003 to 0.1; B: 0.0005 to 0.014; Co: 0.003 to 3; W: 0.03 to 2; Zr: 0.03 to 1; Ca: less than 0.004: Sn: less than 0.5, or for the ahoy composition the equation 0.11<C+Al<3 is satisfied with optional addition by alloying of one or more of the following elements: Ti: 0.002 to 0.07; V: 0.006 to 0.1; Cr: 0.05 to 4; Cu: 0.05 to 2; Nb: 0.003 to 0.1; B: 0.0005 to 0.014; Co: 0.003 to 3; W: 0.03 to 2; Zr: 0.03 to 1; Ca: less than 0.004; Sn: less than 0.5, or the alloy composition, hi addition to Ni, contains at least one or more of the elements B, V, Nb, Co, W or Zr with optional addition by alloying of one or more of the following elements: Ti: 0.002 to 0.07; Cr: 0.05 to 4; Cu: 0.05 to 2; Ca: less than 0.004; Sn: less than 0.5, via the blast furnace steel plant or electric arc furnace steel plant process route with optional vacuum treatment of the melt;

casting the steel hi a continuous casting method to form a string and dividing the string into a cast string portion, in particular a solid block, heating the block to a forming temperature of 700° C. to 1250° C., piercing the block at the forming temperature to form a hollow block, optionally re-heating the hollow block prior to hot rolling to 700° C. to 1250° C., hot rolling to form a seamless pipe, e.g. in a plug rolling mill, skew rolling mill, detaching rolling mill, Diescher rolling mill, Ansel rolling mill, continuous rolling mill, pilger rolling mill or a push bench installation with e.g. the following sequence: producing a hollow block from a pre-block, subsequently extending (stretching) the hollow block to form a hollow (thick-walled pipe) and finish-rolling the hollow to form the pipe, optionally intermediately heating between the rolling steps to a temperature of 60° C. to 1250° C., optionally finish-rolling the seamless pipe at a temperature of room temperature to less than Ac3 temperature, preferably 60° C. to 450° C., preferably utilizing the TWIP effect, optionally acid-cleaning the pipe, optionally temper rolling or calibration rolling or otherwise subsequently forming the pipe e.g. drawing by means of a reducing ring, widening or internal high-pressure forming, optionally at a temperature of room temperature to less than Ac3 temperature, preferably 60° C. to 450° C., optionally utilizing the TRIP effect upon forming at room temperature to 60° C. in order to achieve a higher strength, optionally utilizing the TWIP effect upon forming in a temperature range of 60° C. to 450° C. in order to achieve a higher residual elongation at fracture and higher yield strength, optionally finally heat-treating at 400° C. to 900° C. for 1 min to 24 h in a continuous or discontinuously operating annealing device, wherein shorter times tend to be associated with higher temperatures and vice-versa, optionally further processing the seamless pipe to form a component by means of internal high-pressure forming, warm forming or warm internal high-pressure forming.

A solid block (round cast bar) is essentially understood to mean a cast string portion produced by round string casting, said portion already having a desired length.

In conjunction with the above method, reference is explicitly made to the fact that all of, or any combination of, the method steps stated as being optional may also be necessarily present in the method.

Warm forming or warm internal high-pressure forming refer in this case to forming and internal high-pressure forming methods in which at least the first forming step is performed at a temperature above room temperature to below the Ac3 temperature, preferably at 60° C. to 450° C.

Trials have been carried out to investigate the mechanical properties of the steel products produced in accordance with the invention, using e.g. alloys 1 and 2 and using a standard alloy. The standard alloy and alloys 1 and 2 contain the following elements in the stated quantities in wt. %:

| Alloy | C | Ni | Mn | Si | P | S | Mo | V | B |
|---|---|---|---|---|---|---|---|---|---|
| X8Ni9/1.5662 (standard) | Max. 0.1 | 8.5-10.0 | 0.3-0.8 | Max. 0.35 | Max. 0.02 | Max. 0.01 | Max. 0.1 | Max. 0.05 | — |
| Alloy 1 | 0.03 | 0.004 | 6.4 | 0.12 | 0.023 | 0.006 | 0.43 | — | 0.001 |
| Alloy 2 | 0.06 | 0.004 | 6.3 | 0.12 | 0.022 | 0.006 | 0.43 | — | — |

The steel products produced from the above alloys were subjected to different heat treatments and the notch impact energy was measured according to the Charpy notch impact test with V-notch:

| Alloy | State | Heat treatment | Notch impact energy at-196° C. [J/cm$^2$] in transverse direction |
|---|---|---|---|
| X8Ni9/1.5662 (standard) | tempered | as per standard 1.5662 | ≥50 |
| Alloy 1 | annealed | 600° C., 2.5 h | ≥64 |
| Alloy 2 | annealed | 580° C., 4 h | ≥58 |

Properties of the steel strips produced from the above alloys were also determined with the same treatment state. Characteristic values for hot strip/thick plate are shown hereinafter:

| Alloy | Re upper yield strength) [MPa] | Rm [MPa] | Elongation at fracture (A50) [%] |
|---|---|---|---|
| X8Ni9/1.5662 (standard) | >585 | 680-820 | >13.7 |
| Alloy 1 | 790 | 820 | 17.6 |
| Alloy 2 | 855 | 867 | 11.5 |

The elongation at fracture A50 of X8Ni9 was converted in accordance with DIN ISO 2566/1 from the elongation at fracture A5.65 of the standard to a sample cross-section of 20 mm. The elongation characteristic values represent the elongation in the rolling direction.

What is claimed is:

1. A steel product for low temperature use with a notch impact energy of ≥50 J/cm$^2$ according to the Charpy notch impact test with V-notch at −196° C. in a transverse direction, said steel product comprising a following chemical composition in wt. %: C: 0.01 to <0.3; Mn: 4 to <10; Al: 0.003 to 2.9; Mo: 0.01 to 0.8; Si: 0.02 to 0.8; Ni: 0.01 to 3; P: <0,04; S: <0,02; N: <0.02; with the remainder being iron including unavoidable steel-associated elements, wherein an alloy composition satisfies the equation 6<1.5 Mn+Ni<7.5, with optional addition by alloying of one or more of the following elements in wt. %: Ti: 0,002 to 0.5; V: 0.006 to 0.1; Cr: 0.05 to 4; Cu: 0.05 to 2; Nb: 0.003 to 0,1; B: 0.0005 to 0.014; Co: 0,003 to 3; W: 0.03 to 2; Zr: 0.03 to 1; Ca: <0.004 and Sn: <0.5;

said steel product comprising a microstructure of 2 to 90 vol. % austenite, less than 40 vol. % ferrite and/or bainite, with the remainder being martensite.

2. The steel product of claim 1, constructed in the form of in particular a seamless pipe, wherein the microstructure has an austenite content of 2 to 80 vol. %, a ferrite or bainite content of less than 20 vol. %, with the remainder being martensite.

3. The steel product of claim 1, wherein a proportion of at least 20% of the martensite is present as annealed martensite.

4. The steel product of claim 1, wherein a proportion of up to 90% of the austenite is present in the form of annealing or deformation twins.

5. The steel product of claim 1, wherein the steel product has an elasticity limit Rp0.2 of 450 to 1050 MPa, a tensile strength Rm of 500 to 1500 MPa and an elongation at fracture A50 of 6 to 45%.

6. The steel product of claim 1, further comprising a metallic, inorganic or organic coating and optionally one or more other metallic, various inorganic or organic coatings are applied to the coating.

7. The steel product of claim 1, wherein in wt. % C: 0.03 to 0.15; Mn: 4 to <8; Al: 0.03 to 0.4; Mo: 0.1 to 0.5; Si: 0.08 to 0.3.

8. The steel product of claim 2, wherein the microstructure has an austenite content of 2-70 vol. %.

9. A steel product for low temperature use with a notch impact energy of ≥50 J/cm$^2$ according to the Charpy notch impact test with V-notch at −196° C. in a transverse direction, said steel product comprising a following chemical composition in wt. %: C: 0.01 to <0.3; Mn: 4 to <10; Al: 0.003 to 2.9; Mo: 0.01 to 0.8; Si: 0.02 to 0.8; Ni: 0.01 to 3; P: <0.04; 3: <0.02; N: <0.02; with the remainder being iron including unavoidable steel-associated elements, wherein an alloy composition satisfies the equation 0.15<C+Al<3, with optional addition by alloying of one or more of the following elements in wt. %: Ti: 0.002 to 0.5; V: 0.006 to 0.1; Cr: 0.05 to 4; Cu: 0.05 to 2; Nb: 0.003 to 0.1; B: 0.0005 to 0.014; Co: 0.003 to 3; W: 0.03 to 2; Zr: 0.03 to 1; Ca: <0.004 and Sn: <0.5;

said steel product comprising a microstructure of 2 to 90 vol. % austenite, less than 40 vol. % ferrite and/or bainite, with the remainder being martensite.

10. The steel product of claim 9, constructed in the form of in particular a seamless pipe, wherein the microstructure has an austenite content of 2 to 80 vol. %, a ferrite or bainite content of less than 20 vol. %, with the remainder being martensite.

11. The steel product of claim 9, wherein a proportion of at least 20% of the martensite is present as annealed martensite.

12. The steel product of claim 9, wherein a proportion of up to 90% of the austenite is present in the form of annealing or deformation twins.

13. The steel product of claim 9, wherein the steel product has an elasticity limit Rp0.2 of 450 to 1050 MPa, a tensile strength Rm of 500 to 1500 MPa and an elongation at fracture A50 of 6 to 45%.

14. The steel product of claim 9, further comprising a metallic, inorganic or organic coating and optionally one or more other metallic, various inorganic or organic coatings are applied to the coating.

15. The steel product of claim 9, wherein in wt. %: C: 0.03 to 0.15; Mn: 4 to <8; Al: 0.03 to 0.4; Mo: 0.1 to 0.5; Si: 0.08 to 0.3.

16. The steel product of claim 10, wherein the microstructure has an austenite content of 2-70 vol. %.

* * * * *